United States Patent [19]

Bouchard et al.

[11] 4,161,388

[45] Jul. 17, 1979

[54] SIGNAL DEVICE HAVING PROLONGED ILLUMINATION MEANS

[75] Inventors: Andre C. Bouchard, Peabody; Lawrence R. Fraley, Ipswich, both of Mass.

[73] Assignee: GTE Sylvania Incorporated, Stamford, Conn.

[21] Appl. No.: 778,395

[22] Filed: Mar. 17, 1977

[51] Int. Cl.[2] ..... F21K 5/02; F21L 25/00; F21K 2/00

[52] U.S. Cl. ..... 431/359; 362/84; 362/109; 362/159; 362/185

[58] Field of Search ..... 431/93, 94; 362/13, 362/16, 17, 18, 84, 109, 159, 166, 185, 189

[56] References Cited

U.S. PATENT DOCUMENTS

| | | | |
|---|---|---|---|
| 2,358,867 | 9/1944 | Madan | 362/84 X |
| 2,905,863 | 9/1959 | Martin et al. | 362/84 X |
| 3,796,869 | 3/1974 | Stone | 362/84 |
| 3,851,163 | 11/1974 | Stacy | 431/92 X |
| 4,055,759 | 10/1977 | Bouchard et al. | 362/13 X |

*Primary Examiner*—Carlton R. Croyle
*Assistant Examiner*—Leonard E. Smith
*Attorney, Agent, or Firm*—Lawrence R. Fraley

[57] ABSTRACT

A flashlamp signal device which includes an illumination means for providing a prolonged, visible signal after actuation of each of the device's flashlamps. The illumination means may be in the form of a phosphor coating within the device or on an adjacent, movable panel, or the phosphor may be impregnated within the light-transmitting housing or support structure of the device.

13 Claims, 5 Drawing Figures

SIGNAL DEVICE HAVING PROLONGED ILLUMINATION MEANS

CROSS REFERENCE TO COPENDING APPLICATIONS

An application under Ser. No. 778,394 was filed Mar. 17, 1977 and is assigned to the assignee of the present invention. Ser. No. 778,394 defines an improved flashlamp assembly which incorporates a movable retention means to retain the assembly's carriage prior to firing of the lamps.

Three applications, listed under Ser. Nos. 756,926, 756, 927 and 756,928 were filed Jan. 4, 1977 and are assigned to the same assignee as the present invention. Ser. No. 756,927 describes a flashlamp signal device which utilizes a slidable carriage to maintain alignment of the device's mechanism. Ser. No. 756,928 describes a flashlamp signal device in which the device's body member has a handle and movable trigger. Ser. No. 756,926 is an application for design for a flashlamp assembly.

Another previous application now U.S. Pat. No. 4,076,488 (H. H. Hall et al), filed June 14, 1976 and assigned to the same assignee as the present invention, defines a flashlamp assembly which employs a spring-loaded ratchet bar and a slidable member, e.g., helical torsion spring, which fires the assembly's flashlamps during movement of the ratchet bar. Ser. No. 696,146 is now U.S. Pat. No. 4,076,488.

Two additional applications were also filed June 14, 1976 and are now U.S. Pat. No. 4,070,145 (H. H. Hall et al) and 4,055,759 (Bouchard et al) and are also assigned to the same assignee as the present invention. Both of these patents describe percussive flashlamp signal devices wherein each of the lamps has a preenergized striker, e.g. torsion spring, associated therewith.

It will be understood from the following description that the prolonged illumination means of the invention is operable with all of the above flashlamp assemblies.

BACKGROUND OF THE INVENTION

The present invention relates to flashlamp asemblies and more particularly to flashlamp assemblies for use as signal devices.

All of the signal devices and assemblies in the above applications utilize flashlamps as the light source. The most preferred flashlamps are those of the percussive variety which include a deformable, hollow primer projecting from the lamp's envelope. Deformation of the primer causes a quantity of fulminating material to deflagrate up through the primer and ignite a quantity of filamentary combustible material e.g. zirconium, located within the envelope. Flashlamps of this type produce a relatively high intense light output during a very brief time period, e.g., 12–13 milliseconds. Understandably, it is highly desirable during situations of warning and distress to provide a highly intense visible signal for a much longer duration.

It is believed therefore that a flashlamp signal device capable of providing a prolonged illumination would constitute an advancement in the art.

OBJECTS AND SUMMARY OF THE INVENTION

It is a primary object of the present invention to enhance the flashlamp signal device art by providing such a device which is capable of emitting a prolonged, visible illumination subsequent to the termination of actuation of the device's flashlamps.

It is a further object to provide such a device wherein the prolonged illumination means is operatively joined to the flashlamps and responsive to the light emitted therefrom.

In accordance with one aspect of the invention, there is provided an improved light-emitting flashlamp assembly which comprises a supportive structure, a light-transmitting housing located on the supportive structure, at least one flashlamp within the structure, and means for actuating (or firing) the lamp. The improvement comprises a light responsive illumination means in operative relationship to the device's flashlamp, said means providing a prolonged illumination in response to the light emitted from the flashlamp during actuation thereof.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
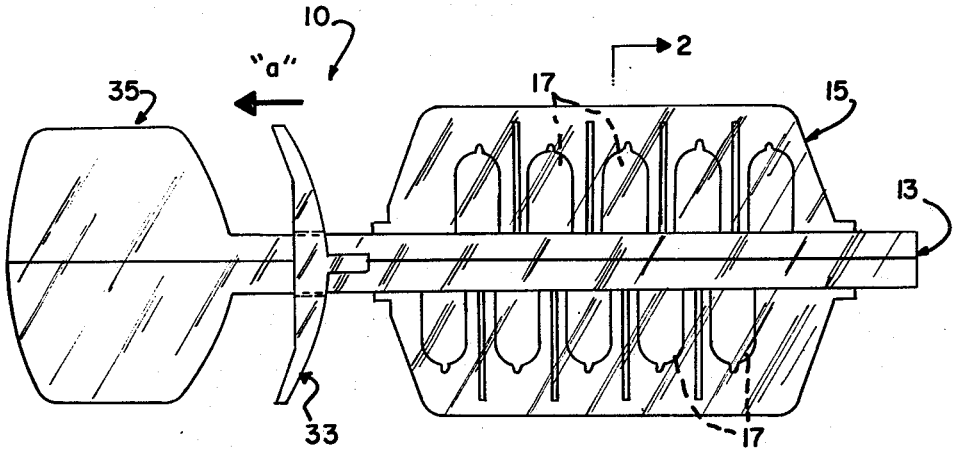
FIG. 1 is a front elevational view of an improved light-emitting flashlamp assembly in accordance with a preferred embodiment of the invention.

With particular reference to the drawings, in FIG. 1 there is shown an improved flashlamp assembly 10 in accordance with a preferred embodiment of the invention. Like most of the flashlamp assemblies in the above prior applications, assembly 10 may be used as a signal device and comprises a supportive structure 13, a light-transmitting housing or cover 15, at least one flashlamp 17 mounted within supportive structure 13, and means 19 (FIG. 2) for actuating flashlamp 17 to provide the desired highly intense light output from assembly 10. The assembly preferably includes several, e.g. ten, flashlamps disposed in two opposing rows within structure 13. Each of the lamps 17 is preferably of the percussive variety.

Figure 2:
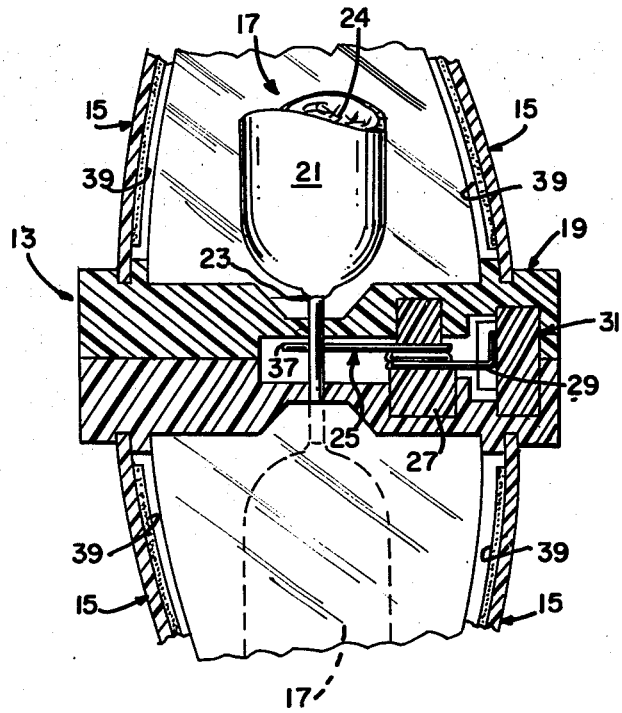
FIG. 2 is an end elevational view as taken along the line 2—2 in FIG. 1.

In FIG. 2, each lamp 17 is shown as comprising an envelope 21 and a primer 23 projecting therefrom. Within envelope 21 is a quantity of shredded combustible material 24, e.g. zirconium, which ignites upon deformation of primer 23. This deformation is accomplished by a torsion spring 25 mounted on a movable carriage 27 and operatively joined via an extending arm 29 to a toothed ratchet 31. The aforementioned spring 25, carriage 27 and ratchet 31 constitute the preferred actuation means 19 of the invention. Ratchet 31 is joined to a movable trigger 33 (FIG. 1) which is activated by the fingers of the operator. Means 19 is fully described in the copending application under Ser. No. 765,926 and therefore does not constitute the inventive contribution of the present application but instead represents the preferred manner for achieving actuation of each of the lamps 17. It is understood, however, that several other actuating means could be successfully employed in the instant invention.

Assembly 10 also includes a handle 35 to permit singlehanded operation of the assembly. Accordingly, when an operator grips handle 35 and depresses trigger 33 toward the handle (in direction "a"), a singular flashlamp 17 is fired. This occurs as a result of the dual movement of carriage 27 and ratchet 31 in direction "a" to cause an arm 37 of spring 25 to strike and deform primer 23. Repeating the above operation causes subsequent firing of all of the lamps 17 in a singular, alternating (top, bottom, top, etc.) manner.

Figure 3:
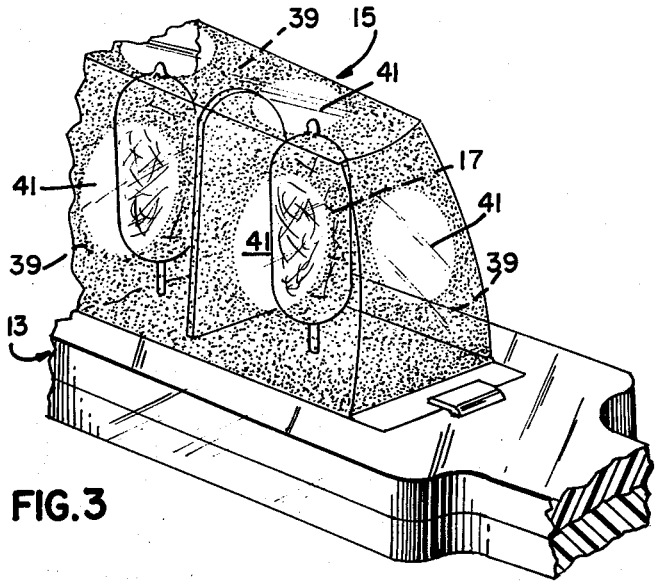
FIG. 3 is a partial enlarged isometric view of the assembly of FIGS. 1 and 2.

As previously stated, it is highly desirable in situations of warning, distress, etc. to provide a prolonged, visible signal in addition to an initial highly intense flash. Accordingly, a primary feature of the present invention is the provision of a light responsive illumination means in operative relationship to the flashlamps of assembly 10 to provide a prolonged illumination in response to the highly intense light emitted from the lamps. This light responsive illumination means preferably comprises a long decay photoluminescent composition, e.g. a daylight activated phosphor, having a peak excitation within the range of about 350 to 700 nanometers and a peak emission within the visible spectrum range (about 380 to about 760 nanometers). An excitation range as defined is compatible with the light output of most flashlamps, particularly those of the percussive variety. Percussively-ignitable flashlamps, such as those employed in the well known multilamp article "MAGICUBE" as produced and sold by the assignee of this invention, each generate an output of about 2000 beam candle power seconds with a peak intensity occurring within about 5 to 10 milliseconds. The illumination means of the invention as shown in FIGS. 2 and 3 comprises a phosphor coating 39 disposed on the interior surface of light transmitting housing 15 relative to a respective flashlamp 17. When lamp 17 is fired, the light therefrom activates the phosphor coating 39 to thereafter provide a visible, prolonged indication. It is clearly shown in FIG. 2 that each lamp 17 directly activates the internal coating 39. To assure that the initial, highly intense output of lamps 17 is not diminished, a plurality of uncoated apertures 41 may be provided relative to each lamp.

As stated, the preferred prolonged illumination means of the invention is a daylight activated phosphor. These compositions, several of which are produced by the assignee of the present invention, are well known in the art and are currently available on the market. Those manufactured by the present assignee are listed under GTE Sylvania Incorporated classifications as Types 911, 915, 920, 923, 930, 940, and 950 and include copper activated zinc sulfides, copper-manganese activated zinc sulfides, bismuth activated calcium strontium sulfides, and europium activated calcium strontium sulfides. Of the above, copper activated zinc sulfide is the most preferred. It is of course understood that several other photoluminescent compositions having the basic excitation and emission characteristics of the above materials may be successfully used.

Daylight activated phosphors are known as being capable of emitting light after the exciting source has been removed. Often these materials exhibit greater than 10 percent of their original illuminating intensity more than a minute after termination of excitation. The afterglow may last from 30 minutes to 10 or 12 hours or more, depending on the pigment, after which it can be repeated again and again by renewed exposure to the respective light source. These phosphors can easily be incorporated within clear thermoplastics such as methyl methacrylate, high-impact polystyrene, cellulose acetate butyrate, and vinyl-chloride-acetate copolymer, said compositions representing the preferred materials for supporting structure 13 and housing 15. Many of these compositions may also be incorporated within thermosetting plastics, should these materials be used for assembly 10. As examples of the invention, cellulose acetate butyrate housings having from about 5 to 25 percent (by weight) copper activated zinc sulfide therein were successfully tested. Preferably, the phosphor will constitute about 15 percent by weight of the impregnated part. In the above examples, the housing was positioned about 0.25 inch from the activating flashlamp. In addition to the supportive structure and housing, it may also be desirable to incorporate these phosphorescent pigments within the trigger 33 and/or handle 35 of assembly 10.

Coating the interior surface of housing 15 with phosphor 39 may be done by any of several well known phosphor coating techniques, e.g. spraying, and further description is therefore not believed necessary. Impregnation of the phosphorescent pigments within the various plastic parts of assembly 10 is of course preferably accomplished at the time of molding these members. This also assures uniformity of distribution of the pigments. Pre-drying of the molding granules is good practice, particularly in the case of those resins most susceptible to moisture. Excessive molding temperatures should be avoided to prevent scorching; however, the temperature should be sufficiently high to fill the mold and give a smooth molding. In some cases the addition of mold lubricants to the compound will be helpful in improving flow and surface finish characteristics.

Figure 4:
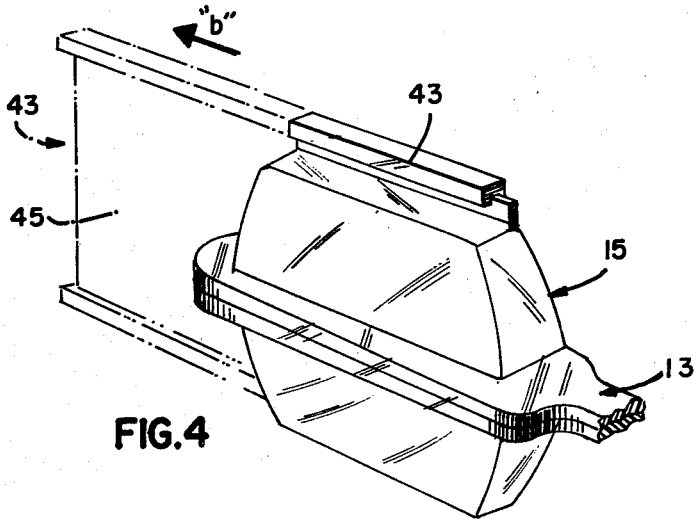
FIG. 4 is a partial isometric view of a flashlamp assembly utilizing a movable panel.
Figure 5:
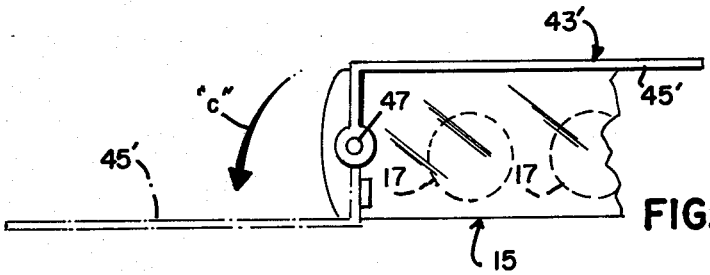
FIG. 5 is a partial top view of another form of movable panel for use with a flashlamp assembly.

FIGS. 4 and 5 represent alternate embodiments of the invention. In FIG. 4, a sliding panel is shown as being mounted on one side of housing 15. To operate the assembly, panel 43 is slid away from housing 15 (in direction "b") to a location relative to the flashlamps (not shown) positioned within the housing. At least one surface 45 of panel 43 is coated with one of the phosphors described above and is thus responsive to the lamp output. Another form of the invention is shown in FIG. 5 where a rotatable panel 43' moves about pivot 47 on housing 15. Similar to sliding panel 43, panel 43' has a phosphor coating on at least one surface 45' thereof. When rotated about pivot 47 (in direction "c"), surface 45' is positioned such that the phosphor coating thereon is located facing the flashlamps 17 within housing 15 and thus responsive thereto.

Thus there has been shown and described means for providing a flashlamp assembly such as a signal device with a prolonged illumination, said means response to (activated by) the light emitted from the assembly's flashlamps. Because the invention is capable of utilizing percussively ignitable flashlamps, the need for electrical circuitry and components, e.g. batteries, resistors, etc. is eliminated. This feature is particularly advantageous when it is desirable to use the invention in an environment adverse to exposed electrical equipment. It is also understood however that the present invention is capable of utilizing electrically actuated flashlamps many of which are well known in the art.

While there have been shown and described what are at present considered the preferred embodiments of the invention, it will be obvious to those skilled in the art that various changes and modifications may be made therein without departing from the scope of the invention as defined by the appended claims.

What is claimed is:

1. In combination, a hand-operable distress signal device comprising:

a supportive structure;

a plurality of percussively-ignitable flashlamps positioned within said supportive structure each for providing a highly intense light output upon actuation thereof, each of said flashlamps including a light-transmitting envelope and a primer tube projection therefrom;

means for singularly actuating each of said flashlamps, said means including a resilient striking mechanism for striking each of said primer tubes to effect deformation thereof;

a light-transmitting housing for covering said flashlamps, said housing positioned on said supportive structure and including an interior surface adjacent each of said flashlamps; and a coating of a long decay photoluminescent material having an excitation range compatible with said high intense light output of said percussively-ignitable flashlamps and positioned on said interior surface of said housing adjacent each of said flashlamps in operative relationship thereto, said photoluminescent material directly receiving the highly intense light emitted from each of said flashlamps and providing a prolonged, visible illumination in response to said direct receipt of light.

2. The signal device according to claim 1 wherein said interior surface of said housing includes a plurality of uncoated aperture portions thereon relative to each of said flashlamps for permitting said highly intense light output from said flashlamps to pass therethrough.

3. The signal device according to claim 1 wherein said photoluminescent material is a daylight activated phosphor having a peak excitation within the range of about 350 to about 700 nanometers and a peak emission within the range of about 380 to about 760 nanometers.

4. The signal device according to claim 3 wherein said phosphor is selected from the group consisting of copper activated zinc sulfide, copper-manganese activated zinc sulfide, bismuth activated calcium strontium sulfide, and europium activated calcium strontium sulfide.

5. In combination, a hand-operable distress signal device comprising:

a supportive structure;

a plurality of percussively-ignitable flashlamps positioned within said supportive structure each for providing a highly intense light output upon actuation thereof, each of said flashlamps including a light-transmitting envelope and a primer tube projecting therefrom;

means for singularly actuating each of said flashlamps, said means including a resilient striking mechanism for striking each of said primer tubes to effect deformation thereof;

a light-transmitting plastic housing for covering said flashlamps, said housing positioned on said supportive structure adjacent each of said flashlamps; and a long decay photoluminescent material having an excitation range compatible with said high intense light output of said percussively-ignitable flashlamps and impregnated within said light-transmitting housing adjacent and in operative relationship to each of said flashlamps, said photoluminescent material directly receiving the highly intense light emitted from each of said flashlamps and providing a prolonged visible illumination in response to said direct receipt of light, said photoluminescent material comprising from about 5 to about 25 percent by weight of said light-transmitting plastic housing.

6. The signal device according to claim 5 wherein said supportive structure is plastic, said long decay photoluminescent material also impregnated within said supportive structure.

7. The signal device according to claim 5 wherein said photoluminescent material is a daylight activated phosphor having a peak excitation within the range of about 350 to about 700 nanometers and a peak emission within the range of about 380 to about 760 nanometers.

8. The signal device according to claim 7 wherein said phosphor is selected from the group consisting of copper activated zinc sulfide, copper-manganese activated zinc sulfide, bismuth activated calcium strontium sulfide, and europium activated calcium strontium sulfide.

9. In combination, a hand-operable signal device comprising:

a supportive structure;

a plurality of percussively-ignitable flashlamps positioned within said supportive structure each for providing a highly intense light output upon actuation thereof, each of said flashlamps including a light-transmitting envelope and a primer tube projecting therefrom;

means for singularly actuating each of said flashlamps, said means including a resilient striking mechanism for striking each of said primer tubes to effect deformation thereof;

a light-transmitting housing for covering said flashlamps, said housing positioned on said supportive structure adjacent each of said flashlamps;

a panel member movably oriented on said light-transmitting housing for movement to a location relative to said flashlamps; and a coating of a long decay photoluminescent material positioned on said panel member, said photoluminescent material in operative relationship to each of said flashlamps for receiving the highly intense light emitted from each of said flashlamps and providing a prolonged, visible illumination in response to said receipt of light when said panel member is moved to said location relative to said flashlamps.

10. The signal device according to claim 9 wherein said panel member is slidably positioned on one side of said light-transmitting housing.

11. The signal device according to claim 9 wherein said panel member is pivotally oriented on said light-transmitting housing.

12. The signal device according to claim 9 wherein said long decay photoluminescent material is a daylight activated phosphor having a peak excitation within the range of about 350 to about 700 nanometers and a peak emission within the range of about 380 to about 760 nanomenters.

13. The signal device according to claim 12 wherein said phosphor is selected from the group consisting of copper activated zinc sulfide, copper-manganese activated zinc sulfide, bismuth activated calcium strontium sulfide, europium activated calcium strontium sulfide.

* * * * *